United States Patent [19]

Götzfried

[11] 4,444,003

[45] Apr. 24, 1984

[54] TURBULENT SPINNING APPARATUS FOR THE PRODUCTION OF YARN

[75] Inventor: Konrad Götzfried, Ausburg, Fed. Rep. of Germany

[73] Assignee: Murata Machinery Ltd., Kyoto, Japan

[21] Appl. No.: 343,184

[22] Filed: Jan. 27, 1982

[30] Foreign Application Priority Data

Feb. 3, 1981 [DE] Fed. Rep. of Germany ..... 3103510
Jan. 8, 1982 [DE] Fed. Rep. of Germany ..... 3200378

[51] Int. Cl.[3] ..... D01H 1/13; D02G 3/36
[52] U.S. Cl. ..... 57/5; 57/403
[58] Field of Search ..... 57/401, 403, 5, 6, 358

[56] References Cited

U.S. PATENT DOCUMENTS 2,911,783 11/1959 Gotzfried ..... 57/403
2,928,228 3/1960 Gotzfried ..... 57/403
3,722,198 3/1973 Gotzfried ..... 57/403
4,253,297 3/1981 Pacholski et al. ..... 57/403 X

*Primary Examiner*—John Petrakes

*Attorney, Agent, or Firm*—Toren, McGeady and Stanger

[57] ABSTRACT

In the production of a covered core yarn in pneumatic spinning in a stationary, tubular spinning chamber, an endless thread (2) is covered with staple fibers (1). The staple fibers (1) are brought together with the core thread and are spun overtwisted in a twist blocking device (12). Due to a subsequent partial untwisting of the roving, reverse tying-in of the staple fibers around the core thread is made possible. The staple fibers (1) which are pulled in band form into a turbulence generator (7) from a pair of supply rollers (4) are radially spread successively under negative pressure before twisting by the turbulent air current (17). The turbulent air current (17) flows tangentially in and out through the guide screw of the twist blocking device (12). In one embodiment, the staple fibers (1) are spread in high draft in an eccentrically arranged fiber spreading chamber (8) of the turbulence generator (7) by eccentrically acting turbulent air currents. The fiber spreading chamber (8) of the turbulence generator (7) is eccentrically displaced with respect to the longitudinal axis of the turbulence generator (7).

10 Claims, 7 Drawing Figures

TURBULENT SPINNING APPARATUS FOR THE PRODUCTION OF YARN

The invention relates to a spinning method and a spinning apparatus for the production of yarn of natural and synthetic fibers by means of turbulent air currents, wherein the staple fiber band which is to be drawn out of the supply rollers is stationarily spread in a turbulence generator by turbulent air currents which are produced by laminar suction air flows or compressed air flows, and which after the spreading high drafting is to be spun around the pretwisted core thread without interruption in a subsequent twist blocking means.

Only minimal fiber spreading takes place in the spinning tube without the turbulent spread drafting. These fiber spreadings lead during the reverse untwisting of the falsely twisted roving to no twist fixation if the amount of projecting, short fiber ends is small. Even when additional exposed fibers are applied on the twisted roving, no abrasion-proof tying-in of the staple fibers with the falsely pretwisted thread core can be achieved.

Only with extremely strong, extremely high fiber spreading before the twist blocking means can during the reverse untwisting the twist fixation be increased by an increasing extent after a false twist was imparted.

The task of the invention consists in that by means of turbulent free drawing of the staple fiber ends the latter are spread much more from the entering fiber band and the length of the staple.

The turbulent air current which is to be formed from the laminar suction air flow effects with the radial spread drawing a strong texturizing of the staple fiber band which enters a turbulence generator. Thereby the strongly spread staple fiber ends cover in the twist blocking means the pretwisted core thread during sliding circulation around the guide screw. When the core thread is extremely overtwisted in relation to the spread covering fibers, after a false twist has been imparted, a strong twist fixation results during the reverse strain release for twist compensation.

In a development of the invention the free drawing of the staple fibers can still be increased. A significant advantage of this development consists in that a much stronger covering of the fiber can be achieved.

The invention can be applied in connection with the method and apparatus which are described in the German Pat. No. 20 49 186.

Figures 1, 2, 3:
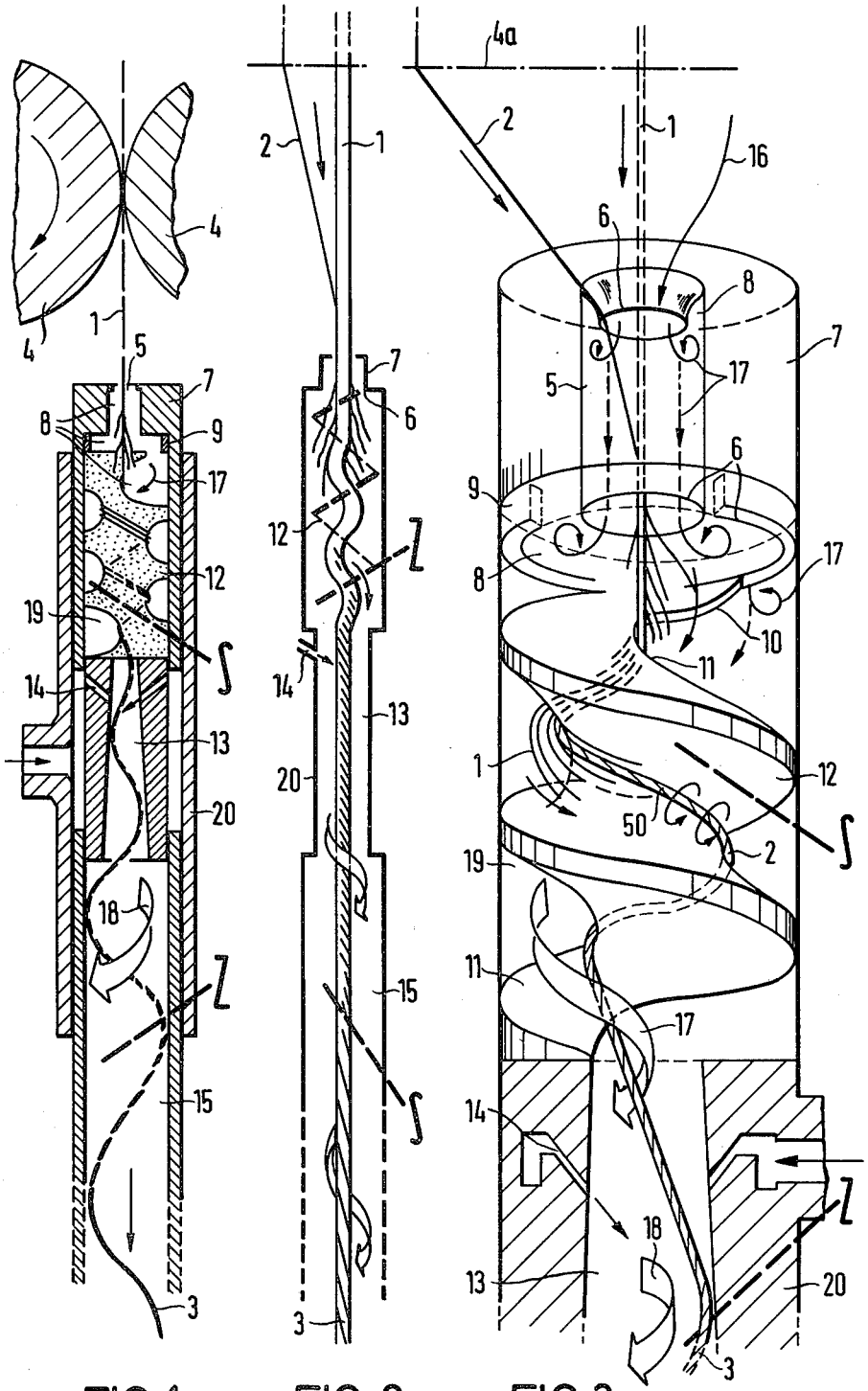

Below the invention and its developments are elucidated with the aid of the Figures. They show:

FIG. 1 a longitudinal section of the arrangement according to the invention, enlarged several times.

FIG. 2 a longitudinal section according to FIG. 1 and the twisting shown schematically.

FIG. 3 a perspective drawing, enlarged many times, of the turbulence generator with the twist blocking means and schematically indicated the course of the turbulent air currents from the different detachment edges to the twist channel which is shown in longitudinal section.

Figure 4:
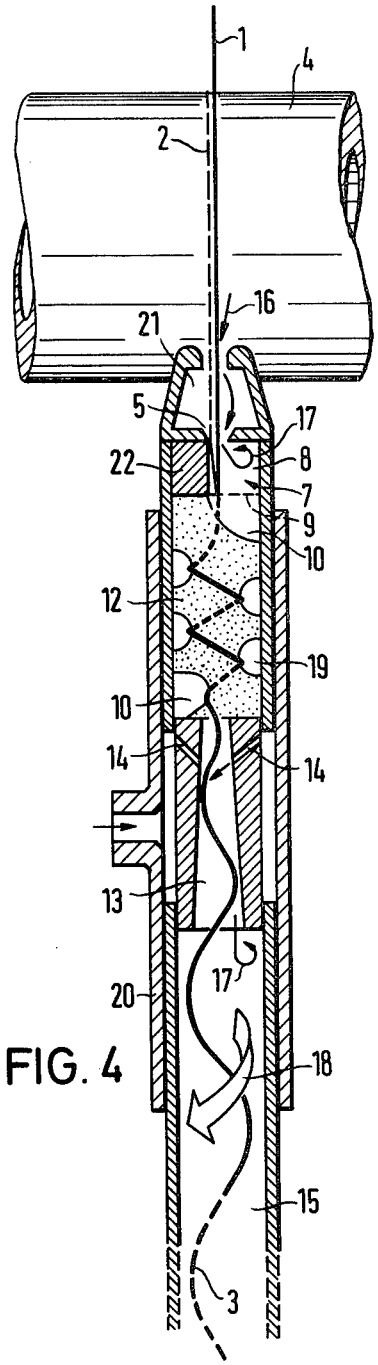

FIG. 4 a longitudinal section through the development of the spinning apparatus according to the invention, viewed from the front, which is provided with an antechamber.

Figure 5:
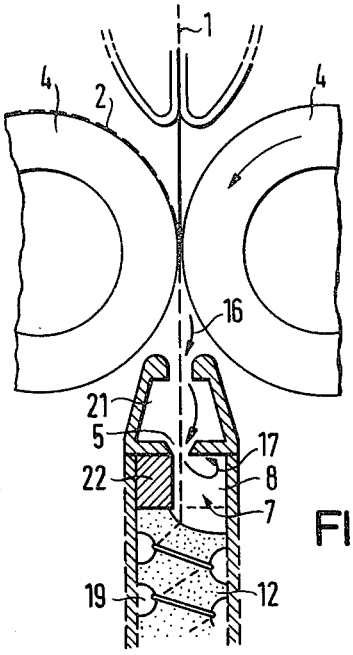

FIG. 5 a longitudinal section from the side through the apparatus shown in FIG. 4.

Figure 6:
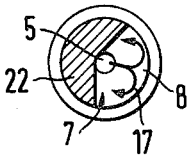

FIG. 6 a top view on the fiber spreading chamber of the development.

Figure 7:
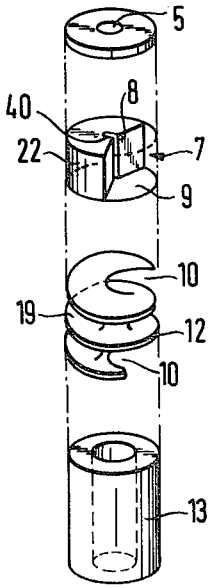

FIG. 7 shows a perspective drawing of the turbulence generator with the twisting channel of the development, wherein the individual parts are shown in an exploded view in the axial direction.

In FIGS. 1 and 3 stationarily mounted spinning tubes 20 with exemplified turbulence generators 7 are shown whose axial section have different cross-sections and shapes.

For performance of this method, the spinning device has, depending on the type of material to be spun, a conventional drawing system from which by means of the outlet of the supply rollers 4 the staple fibers 1 are fed exceeding or below the staple length, in band shape, to the suction opening 5 of a turbulence generator 7.

The endless filaments 2 are used, laterally offset, with the staple fibers 1.

If the fiber suction channel 5 is of conical construction, then the turbulence generator 7 is to be set so as to be controllable as a cartridge-shaped fiber spreading channel in the preferred axial distance from the clamping line 4*a* of the drawing system.

At the inlet, the spinning tube 20 is provided with a turbulence generator 7 for turbulent spreading draft of the staple fiber band 1. A small fiber suction channel 5 serves as the first detachment edge 6 of the air suction flow 16 to several fiber spreading chambers 8 which extend annularly stepped.

For formation of the turbulent air current 17, the laminar suction air flow 16 spreads from the detachment edge 6 of the fiber suction channel 5 to a whirling turbulent air current 17 which can be repeated successively in the annularly stepped expansion of the fiber spreading chamber 8.

The fiber suction channel 5 opens axially under the staple length in relation to the center axis of a guide screw 13 of the twist blocking means which is known per se.

The degree of efficiency of the pneumatic spreading draft, before the twist is imparted, is to be increased from the fiber suction channel 5 up to the guide screw 12 by means of the aerodynamic shapes of the different fiber spreading chambers 8.

The end of the fiber spreading chamber 8 which faces downstream is in connection with a guide screw 12 in a manner known per se. The tangential infeed 11 is provided with a deflection edge 10 as thread guide, as shown in perspective in FIG. 3.

Between the inner wall of the spinning tube 20 and the central axis of the guide screw 12 a helical channel 19 is formed which has tangential inlets and outlets 11.

The guide screw 12 is to be considered a twist blocking means. Downstream the outlet 11 of the guide screw 12 is connected as is known with the twisting channel 13 which is constructed as a cylindrical bore.

Nozzles 14 which are arranged over the periphery, spaced apart, penetrate the walls of the twisting channel 13 in a manner known per se. The openings of the nozzles 14 are directed in such a way that air jets 18 are produced which have a tangential component in relation to the travelling thread 3 and an axial component in the downstream direction.

The air jets form together as usual a whirling air stream 18 which forms a tubular wrapping of rapidly rotating air.

The air jets draw a laminar suction stream 16 through the fiber suction duct 5 to the fiber spreading chamber 8 and through the guide screw 12 into the whirling air stream 18 of the twisting channel 13.

After the short, narrow twisting channel 13, follows, as is known, a strain release channel 15 whose cross-section is expanded compared to the twisting channel 13 so that the twisting effect of the whirling air stream 18 can be reduced.

The spinning tube 20 is many times longer than the nominal staple of the covering fiber 1 and is to be adjusted to be controllable in the preferred distance up to the clamping point of the drawing system 4.

The apparatus operates as follows: The bands 1 and 2 which run out of the clamping line of the supply rollers 4 are held under the tensile stress of the laminar suction air stream 16 and are fed to the fiber suction duct 5 to the expanded suction ducts of the fiber spreading chambers 8.

Due to the smaller fiber suction opening 5 with an annular detachment edge 6 and due to the suction air stream 16 which enters at the fiber suction opening 5, in the expanded suction channel of the fiber spreading chamber 8 the conversion point results at which this flow changes over into turbulence and according to the invention can as the turbulent air current 17 be effective from the detachment edge 6 in direction of the thread movement.

In the considerably transversely directed component of the annular turbulent air current 17 in the negative pressure of the turbulence generator 7 a strong drafting of staple fibers 1 from the fiber strand 1 which is passed through results whereby the loose fiber ends 1 are to be drawn up beyond the staple length.

For the fiber spreading high draft of the staple fibers 1 before the twist is imparted, according to the invention several successive turbulence generators 7 are used. For the subsequent development of turbulent air currents 17, the deflecting edge 10 before the tangential infeed 11 of the guide screw 12 is constructed as an annularly stepped turbulence generator 7.

Subsequently the bands 1 and 2 are drawn in the following twist blocking means tangentially in tightly sliding circulation around the axis of the guide screw 12 to the twisting channel 13. The twist which there was imparted to the roving reacts about the guide screw 12, so that the two bands 1 and 2 slowly are twisted at the guide screw 12, while the lateral pressure decreases, and a thread 3 is formed which has a strongly overtwisted thread core 2. The strongest twist occurs at the transition of the guide screw 12 into the twisting channel 13. A reverse expansion of the twist in direction towards the fiber spreading chamber 8 is thus prevented by means of the twist blocking means 12.

In the strain release tube 15 which follows the twisting channel 13 the twisting effect decreases due to the widened diameter so that the overtwisted thread 3 is untwisted in a varying manner. This results in a twisting action on the cover fiber 1 whereby the latter is spun in reverse around the core of this thread. The completely covered thread 3 is then removed under slight thread tension from the strain release tube 15. The strain release tube 15 may optionally be connected to a wider suction channel with a thread outlet arranged at the opposite side.

Due to the increases of the fiber spreading radial drafts, the winding of the free ends of the staple fibers 1 must be more intensive when the axial speed of the fiber suction flow 16 goes beyond a specific limit. Therefore the lateral, radially spreading draft speeds of the staple fibers 1 are much greater than the running and removal speeds of the thread 2 and 3 so that a considerable increase of the looping fiber tie-ins around the pretwisted core thread 2 can take place.

In several successive turbulence generators 7 the fiber suction channel 5 has a smaller passage cross-section compared to the widened detachment edges 9, 6 and the deflection edge 10.

The staple fibers 1 receive in the fiber spreading high draft in the subsequent screw channel 19 of the twist blocking means 12 a free-ended false twist 50 around the greatly overtwisted core thread 2.

For a tighter spinning of the staple fibers 1 around the core thread 2, the helical channel 19 of the immovable guide screw 12 has in the twist blocking means an oppositely directed screw turn, for instance an S- or Z-turn, compared to the screw spiral of the pretwisted core thread 2, as can be concluded in FIGS. 1, 2 and 3 from the obliquely indicated directional line of the twist. The back and forth sliding start in the manner of a screw of the false-real twist 50 in the helical channel 19 is thereby to be limited by the crossing twisting motion of the thread 2 and the staple length for a short distance in the twist blocking means 12.

In the oppositely oriented twisting surface and sliding surface in the helical channel 19 of the twist blocking means 12 the overtwist of the core thread 2 can therefore not penetrate against the thread movement direction into the turbulence generator 7, so that the spreading high draft of the staple fibers 1 is to be carried out before the false twisting of the thread 2 in the maximum spinning speed ranges according to the invention.

The radially spreading high draft of the staple fibers 1 is to be increased before the false twisting 50 by means of the thread clamping tensile stress of the gliding core thread 2 around the center axis of the guide screw 12 without rotation in the twist-free inlet of the staple fibers 1 from the clamping line of the supply rollers 4.

In order to prevent reverse passage of the pneumatic false twist 50 through the helical channel 19 of the guide screw 12 into the fiber spreading chamber 8 during the highest speed ranges against the movement direction of the thread, an immovable, oppositely directed screw turn of the twist blocking means 12 is necessary in relation to the following false twist 50.

According to the invention, the S-twist of the roving 3 is to be shortened either by means of an immovable, right-handed Z-turn of the twist blocking means 12, or the Z-twist of the roving 3 is to be shortened by means of a left-handed S-turn of the helical channel 19 of the guide screw 12 towards the movement direction of the thread.

With the spinning apparatus of approximately 8 mm inner diameter according to FIG. 3 one can obtain a false-real twisted yarn 3 which has a tighter and more tear-resistant winding of the staple fibers 1 around the endless core thread 2 to the core yarn 3.

Particularly after twisting during the reverse partial untwisting of the falsely overtwisted core thread 2 with the tighter wound staple fibers 1, the corkscrew-shaped shortening of the yarn 3 is to be eliminated during the strain releasing twist compensation. No fibers are passed off when high speeds up to the sound velocity ranges of the narrow twisting flow 18 are used.

Below the development of the invention is elucidated. In FIGS. 4 and 5 the staple fibers are identified with 1 and the endless filaments with 2. Both are removed as an untwisted fiber band from the supply rollers 4 and are fed by means of the laminar suction air flow 16 to the fiber suction opening 5 of the turbulence generator 7. The feed takes place preferably via an antechamber 21 which is connected before the turbulence generator 7. The antechamber 21 is preferably of conical construction and has at its side facing the supply rollers 4 a suction opening which extends preferably annularly stepped to the interior of the antechamber 21.

From the antechamber 21, the staple fibers 1 and the endless filaments 2 reach through the fiber suction opening 5 into the fiber spreading chamber 8 of the turbulence generator 7. The fiber suction opening 5 is preferably constructed as a perforated disk. The fiber spreading chamber 8 of the turbulence generator 7 is, as is evident in FIGS. 4 to 7, arranged eccentrically in relation to the center axis of the apparatus. The fiber spreading chamber 8 is preferably formed by a shielding piston 22 of the turbulence generator 7 which has a pressed or milled channel that forms the fiber spreading chamber 8. This channel is laterally offset with respect to the longitudinal axis of the apparatus. The channel preferably adjoins the longitudinal axis and has, when a circular shielding piston 22 is used, a cross-section which has the shape of a circular sector.

The twist blocking means 12 with the helical guide channel 19 adjoins the fiber spreading chamber 8 of the turbulence generator 7. The eccentric outlet 9 of the fiber spreading chamber 8 discharges tangentially into the helical guide channel 19 of the twist blocking means 12. At the end of the twist blocking means 12 the outlet 10 of the guide channel 19 changes over tangentially into the twisting channel 13.

Nozzles 14 which are arranged spaced apart annularly over the periphery enter the walls of the twisting channel 13 in a manner known per se. The openings of the nozzles are aligned in such a way that air jets 18 are produced which have a tangential component in relation to the passing threads 3 and an axial component in the downstream direction. The air jets form together a whirling air stream 18 which forms a tubular wrapping of rapidly rotating air. In addition, the air jets pull a laminar suction air flow 16 through the suction opening of the antechamber 21, the fiber suction opening 5 of the turbulence generator 7, the fiber spreading chamber 8 of the turbulence generator 7 and the helical guide channel 19 of the twist blocking means 12.

After the twisting channel 13 follows in a known manner a strain release tube 15 whose cross-section is expanded compared to the twisting channel 13 so that the twisting action of the whirling air stream 8 can be reduced.

Since the fiber suction opening 5, compared to the following passage cross-sections of the fiber spreading chamber 8 and the twist blocking means 12, has a significantly smaller passage cross-section, an extremely high negative pressure results in the fiber spreading chamber 8 which accelerates the spreading turbulent air current 17. Thus the loose fiber ends 1 of the fiber spreading high draft are pulled free to a maximum extent.

A turbulent negative pressure stream prevails from the fiber suction opening 5 up to the twisting channel 13. At the annularly stepped widening of the twisting channel 13 to the strain release tube 15 a turbulent positive pressure stream 17 prevails as indicated schematically for instance in FIG. 4.

During the reverse twist compensation of the yarn thread 3 a tightly pulling alignment and smoothing of the fiber tie-ins is to be brought about, wherein for control of the thread tension from the spinning tube 20 to the yarn winding a conventional braking mechanism which is not shown is interconnected.

Due to the preferably conical construction of the antechamber 21, the fiber suction opening 5 can be brought advantageously close to the clamping line of the supply rollers 4. By means of a suitable mechanical device, not shown, the distance between the clamping line of the supply rollers 4 and the fiber suction opening 5 can be controllably set.

Due to the inner, annularly stepped expansion of the suction opening of the antechamber 21, a texturizing initial drawing of the passing staple fibers 1 can be achieved. Thereby the subsequent spreading of the fibers in the turbulence generator 7 can be increased.

For the subsequent high draft, the circular sector-shaped fiber spreading chamber 8, for instance according to FIG. 7, is provided in the center axis with an axially deepened groove 40 by means of which the staple fiber ends 1 from the slot-shaped gap can be spread to greater lengths during the twist-free passage of the fiber band due to the axially and transversely flowing air draft of the turbulent air current 17.

I claim:

1. An apparatus for the pneumatic spinning of a yarn made up of staple fibers (1) and an endless filament (2) comprising a pair of interacting supply rollers (4) forming a clamping line (4*a*) therebetween, an axially elongated spinning tube (20) arranged in axial alignment with the clamping line (4*a*) of said supply rollers (4), said spinning tube having a first end adjacent to said supply rollers and a second end more remote from said supply rollers, said spinning tube (20) has an inlet opening (5) at the first end thereof for receiving the staple fibers and the endless filament, a helical chamber (19) located downstream from said inlet opening, a first smooth-walled channel (13) located downstream from said helical channel (19), said first channel (13) has an upstream end and a downstream end, nozzles for supplying compressed air open into said first smooth-walled channel (13) close to the upstream end thereof, the openings of said nozzles (14) into said first channel (13) have a tangential component with respect to said first smoothwalled channel (13) and a downstream directed axial component with respect to the first smooth-walled channel (13), wherein the improvement comprises that said inlet opening (5) has an edge (6) at the downstream end thereof, a chamber (8) located between said inlet opening (5) and said helical channel (19) and said chamber (8) has a larger cross-sectional area transverse of the axis of said spinning tube (20) and widens from the downstream said edge (6) of said inlet opening (5).

2. An apparatus, as set forth in claim 1, wherein said chamber (8) widens annularly from the downstream said edge (6) of said inlet opening (5).

3. An apparatus, as set forth in claim 1, wherein said helical channel (19) has an inlet (11) at the upstream end thereof, and said chamber (8) expands from the cross sectional area of said downstream edge (6) to said inlet (11) of said helical channel (19).

4. An apparatus, as set forth in claim 3, wherein said inlet (11) of said helical channel (19) is limited in the radially inward direction by a deflection edge (10) for the staple fibers and the endless filament passing therethrough.

5. An apparatus, as set forth in claim 1, 2 or 3, wherein the cross-sectional area of said helical channel

(19) increases in the direction extending from the first end toward the second end of said spinning tube (20).

6. An apparatus, as set forth in claim 1, 2 or 3, wherein the cross-section of said first smooth-walled channel (13) extending transversely of the axial direction of said spinning tube (20) increases in the direction extending from the first end toward the second end of said spinning tube (20).

7. An apparatus, as set forth in claim 1, 2 or 3, wherein a second smooth-walled channel (15) extends downstream from said first smooth-walled channel (13), and said second smooth-walled channel has a larger cross-sectional area transverse of the axial direction of said spinning tube (20) than said first said smooth-walled channel (13).

8. An apparatus, as set forth in claim 1, 2 or 3, wherein an antechamber (21) is located upstream from and opens to said inlet opening (5) and the cross-sectional area of said antechamber (21) extending transversely of the axial direction of said spinning tube (20) decreases in the direction from said inlet opening (5) toward said clamping line (4*a*) of said supply rollers (4).

9. An apparatus, as set forth in claim 3, wherein said chamber (8) has an axially extending groove (40) aligned with said inlet opening (5).

10. An apparatus, as set forth in claim 9, wherein said chamber (8) is arranged eccentrically relative to said axis of said spinning tube (20) with said groove (40) located on the axis of said spinning tube (20).

* * * * *